US006536578B1

(12) United States Patent
Ashley

(10) Patent No.: US 6,536,578 B1
(45) Date of Patent: Mar. 25, 2003

(54) SENSOR FOR COIN ACCEPTOR

(75) Inventor: Anthony Ashley, Huddersfield (GB)

(73) Assignee: Coin Controls Limited, Royton (GB)

( * ) Notice: Subject to any disclaimer, the term of this patent is extended or adjusted under 35 U.S.C. 154(b) by 0 days.

(21) Appl. No.: 09/830,847

(22) PCT Filed: Nov. 2, 1999

(86) PCT No.: PCT/GB99/03609

§ 371 (c)(1),
(2), (4) Date: Aug. 13, 2001

(87) PCT Pub. No.: WO00/26859

PCT Pub. Date: May 11, 2000

(30) Foreign Application Priority Data

Nov. 2, 1998 (GB) ..... 9823970

(51) Int. Cl.[7] ..... G07D 5/08
(52) U.S. Cl. ..... 194/318; 73/163
(58) Field of Search ..... 194/318, 302, 194/303, 317; 73/163

(56) References Cited

U.S. PATENT DOCUMENTS 4,286,704 A 9/1981 Wood ..... 194/100 A
4,398,626 A 8/1983 Barnes ..... 194/100 A
4,471,864 A * 9/1984 Marshall ..... 194/317
5,353,906 A * 10/1994 Takamisawa et al. ..... 194/319
5,439,089 A * 8/1995 Parker ..... 194/317
5,687,829 A * 11/1997 Churchman ..... 194/317

FOREIGN PATENT DOCUMENTS

| | | | |
|---|---|---|---|
| DE | 30 14 792 | 10/1981 | ..... G07D/5/00 |
| EP | 0 500 367 | 8/1992 | ..... G07D/5/08 |
| EP | 0 704 825 | 3/1995 | ..... G07F/3/02 |
| GB | 2 169 429 | 7/1986 | ..... G07D/5/08 |
| WO | 84/00073 | 1/1984 | ..... G07F/3/02 |

* cited by examiner

*Primary Examiner*—Donald P. Walsh
*Assistant Examiner*—Mark J. Beauchaine
(74) *Attorney, Agent, or Firm*—Morgan & Finnegan LLP

(57) ABSTRACT

A sensor for a coin acceptor includes an inductor connected in a series resonant circuit. The sensor coils are arranged in a series resonant configuration with the resonant capacitance made up of two identical capacitors, one on either side of the sensor. The series resonant configuration reduces the effects on sensor readings of common mode noise on the coin acceptor power supply.

18 Claims, 3 Drawing Sheets

SENSOR FOR COIN ACCEPTOR

FIELD OF THE INVENTION

This invention relates to a sensor for a coin acceptor and has particular but not exclusive application to a multi-denomination coin acceptor.

BACKGROUND

Coin acceptors which discriminate between coins of different denominations are well known and one example is described in our GB-A-2 169 429. The acceptor includes a coin rundown path along which coins pass through a coin sensing station at which sensor coils perform a series of inductive tests on the coins in order to develop coin parameter signals which are indicative of the material and metallic content of the coin under test. The coin parameter signals are digitised so as to provide digital coin parameter data, which is then compared with stored coin data by means of a microcontroller to determine the acceptability or otherwise of the test coin. If the coin is found to be acceptable, the microcontroller operates an accept gate so that the coin is directed to an accept path. Otherwise, the accept gate remains inoperative and the coin is directed to a reject path.

The coin sensing station includes a number of different coils which may be energised at different frequencies, which form individual inductive couplings with the coin under test as it passes through the coin sensing station. Hitherto, the inductive sensor coils have been connected in parallel oscillatory circuits, in the feedback path of an amplifier which maintains the circuits in oscillation. The individual oscillatory circuits are connected in the feedback path of the amplifier sequentially by means of a multiplexer and successive samples of the amplitude deviation that occurs are digitised and fed to the microcontroller. A problem with this prior arrangement is that it takes a finite time for each sensor coil circuit to establish itself in a steady oscillatory condition when it is sequentially switched into the feedback path of the amplifier. This in turn limits the speed at which the multiplexer can scan through the various sensor coil outputs. Also, electrical noise can degrade the accuracy of the outputs of the sensor coils.

EP 0 704 825 discloses a coin validator which includes a coil in a series resonant circuit. One end of the coil is connected to ground, while the other end is connected to the inverting input of a differential amplifier via a capacitor.

SUMMARY OF THE INVENTION

The present invention seeks to provide a sensor for a coin validator which can be scanned at a much faster rate than hitherto, and that is less susceptible to the effects of noise.

In accordance with the invention there is provided a sensor for a coin acceptor, comprising an inductor for forming an inductive coupling with a coin to be tested, connected in series between first and second capacitors in a self oscillating circuit, and a detector to detect changes in oscillatory characteristics of the circuit as the coin passes the inductor.

The first and second capacitors may have substantially the same values.

It has been found in accordance with the invention that the series connected circuit can be brought into operation much more quickly than with prior parallel circuits used hitherto, with a higher resistance to the effects of noise.

The sensor according to the invention may include a plurality of self oscillating circuits and a multiplexer configuration to connect the circuits sequentially to the detector.

The sensor may include means for applying a predetermined bias to the or each self oscillating circuit at switch-on in order to reduce switch-on transients.

The detector may detect the amplitude and/or the frequency of the oscillatory characteristics of the circuit.

BRIEF DESCRIPTION OF THE DRAWINGS

In order that the invention may be more fully understood an embodiment thereof will now be described by way of example with reference to the accompanying drawings in which.

DETAILED DESCRIPTION

Overview of Coin Acceptor

Figure 1:
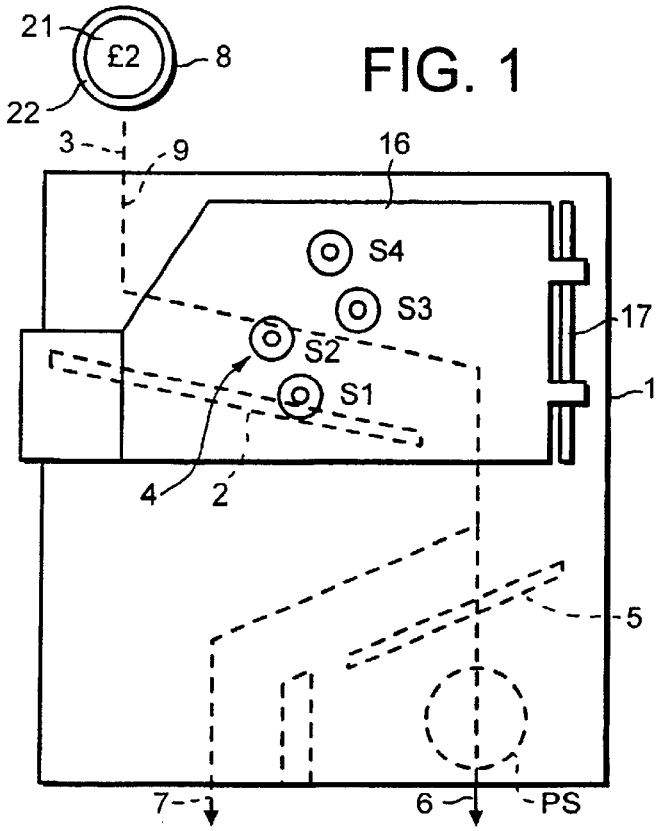
FIG. 1 is a schematic block diagram of a coin acceptor including a sensor in accordance with the invention.

FIG. 1 illustrates the general configuration of a coin acceptor that includes coins sensors according to the invention. The coin acceptor is capable of validating a number of coins of different denominations, including bimet coins, for example the new Euro coin set and the new UK coin set including the new bimet £2.00 coin. The acceptor includes a body 1 with a coin run-down path 2 along which coins under test pass edgewise from an inlet 3 through a coin sensing station 4 and then fall towards a gate 5. A test is performed on each coin as it passes through the sensing station 4. If the outcome of the test indicates the presence of a true coin, the gate 5 is opened so that the coin can pass to an accept path 6, but otherwise the gate remains closed and the coin is deflected to a reject path 7. The coin path through the acceptor for a coin 8 is shown schematically by dotted line 9.

The coin sensing station 4 includes four coin sensing coil units S1, S2, S3 and S4 shown in dotted outline, which are energised in order to produce an inductive coupling with the coin. Also, a coil unit ps is provided in the accept path 6, downstream of the gate 5, to act as a credit sensor in order to detect whether a coin that was determined to be acceptable, has in fact passed into the accept path 6.

Figure 2:
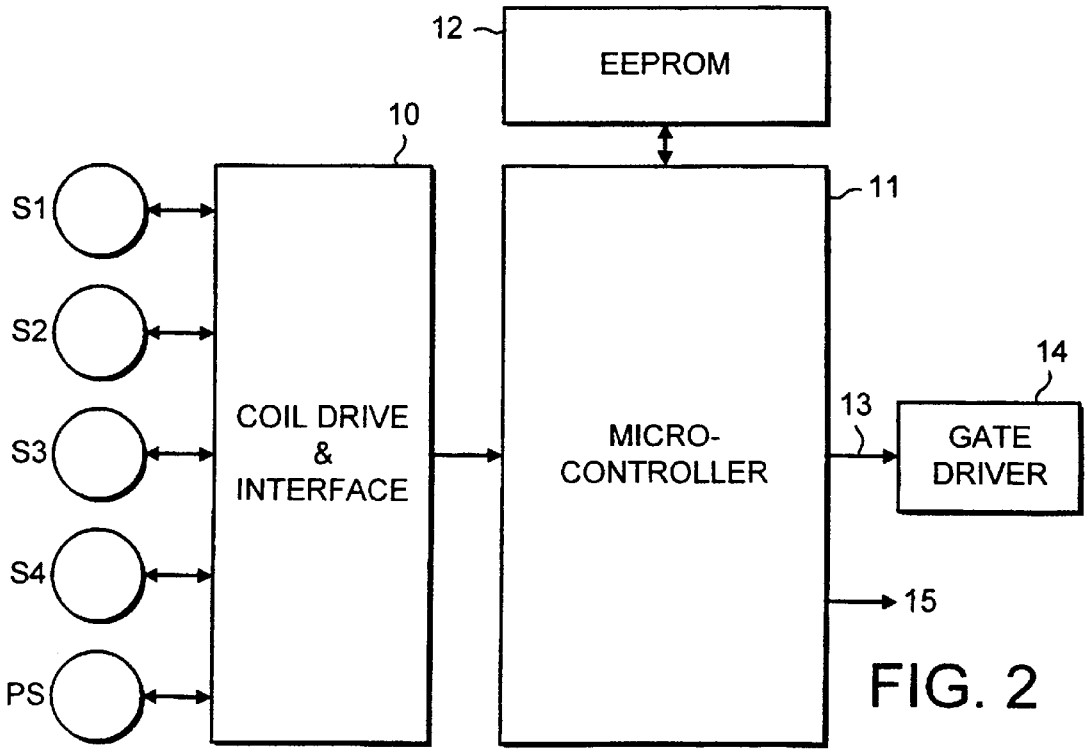
FIG. 2 is a schematic block diagram of the circuits of the sensor shown in FIG. 1.

The coils are energised at different frequencies by a drive and interface circuit 10 shown schematically in FIG. 2. Eddy currents are induced in the coin under test by the coil units. The different inductive couplings between the four coils and the coin characterise the coin substantially uniquely. The drive and interface circuit 10 produces corresponding coin parameter data signals as a function of the different inductive couplings between the coin and the coil units S1, S2, S3 and S4. A corresponding signal is produced for the coil unit PS. The coils S have a small diameter in relation to the diameter of coins under test in order to detect the inductive characteristics of individual chordal regions of the coin. Improved discrimination can be achieved by making the area A of the coil unit S which faces the coin, such as the coil S1, smaller than 72 $mm^2$, which permits the inductive characteristics of individual regions of the coin's face to be sensed.

In order to determine coin authenticity, the coin parameter signals produced by a coin under test are fed to a microcontroller 11 which is coupled to a memory in the form of an EEPROM 12. The microcontroller 11 processes the coin parameter signals derived from the coin under test and compares the outcome with corresponding stored values held in the EEPROM 12. The stored values are held in terms of windows having upper and lower value limits. Thus, if the processed data falls within the corresponding windows associated with a true coin of a particular denomination, the coin is indicated to be acceptable, but otherwise is rejected. If acceptable, a signal is provided on line 13 to a drive circuit 14 which operates the gate 5 shown in FIG. 1 so as to allow the coin to pass to the accept path 6. Otherwise, the gate 5 is not opened and the coin passes to reject path 7.

The microcontroller 11 compares the processed data with a number of different sets of operating window data appropriate for coins of different denominations so that the coin acceptor can accept or reject more than one coin of a particular currency set. If the coin is accepted, its passage along the accept path 6 is detected by the post acceptance credit sensor coil unit PS, and the unit 10 passes corresponding data to the microcontroller 11, which in turn provides an output on line 15 that indicates the amount of monetary credit attributed to the accepted coin.

The sensor coil units S each include one or more inductor coils connected in an individual oscillatory circuit and the coil drive and interface circuit 10 includes a multiplexer to scan outputs from the coil units sequentially, so as to provide data to the microcontroller 11. Each circuit oscillates at a frequency in a range of 50–150 kHz and the circuit components are selected so that each sensor coil S1–S4 has a different natural resonant frequency in order to avoid cross-coupling between them.

Figure 3:
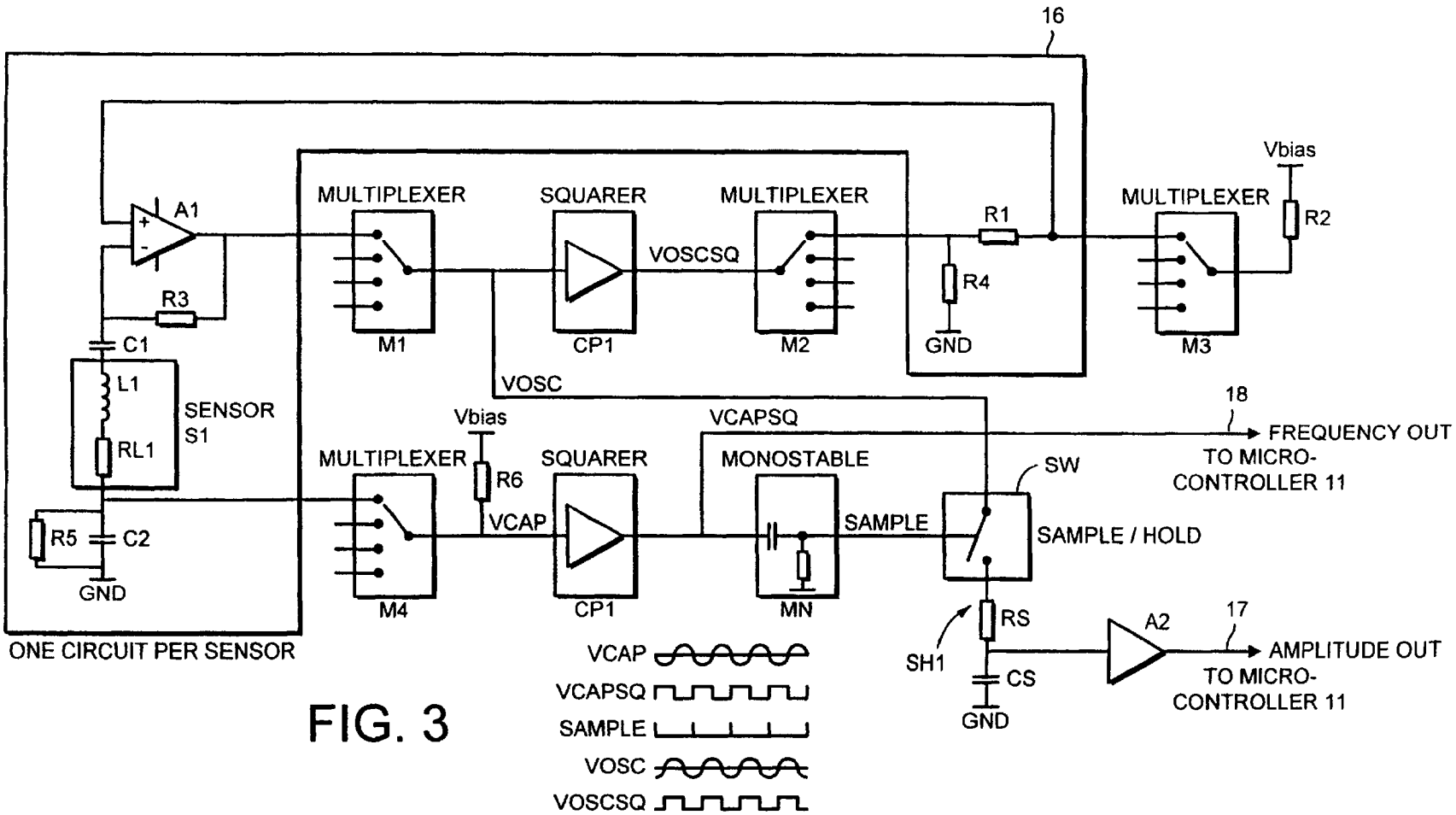
FIG. 3 is a more detailed circuit diagram of the sensor.

As the coin passes the sensor coil unit S1, its impedance is altered by the presence of the coin over a period of 100 milliseconds. As a result, the amplitude of the oscillations through the coil is modified over the period that the coin passes and also the oscillation frequency is altered. The variation in amplitude and frequency resulting from the modulation produced by the coin is used to produce coin parameter signals representative of characteristics of the coin. A more detailed block diagram is shown in FIG. 3 of the coil unit S1 and its associated drive and detection circuitry. Only the circuit for sensor coil unit S1 is shown, referenced 16, it being understood the other sensors S2–4 have identical circuits that are sequentially scanned i.e. switched-in and out of use, using ganged multiplexer switches M1–4 under common control circuitry (not shown).

Oscillator Section

Sensor coil unit S1 includes an inductor coil with an inductance L1 and ohmic resistance RL1, that forms an inductive coupling with the coin as it passes along the rundown path, in a series resonant circuit with capacitor C1 and C2 to form a sensor network that is connected as the input impedance to an amplifier A1. As explained in more detail later, the capacitors, C1 and C2 are preferably of equal value to facilitate noise suppression. In conjunction with feedback resistor R3, the sensor network makes the gain and output phase of A1 frequency dependant. The amplifier A1 has a feedback path from its output to its +ve input through resistor R1 and forms a self oscillating circuit. At resonance, the sensor network has a minimum impedance equal to the sensor resistance RL1 (made up of winding plus loss resistance) and zero phase shift. The amplifier therefore has maximum gain and zero phase shift at the resonant frequency. A limited proportion of the output is thus fed back to the +ve input causing A1 to oscillate at the resonant frequency. If the oscillation was allowed to build up naturally when switching to a new sensor it would take one or two milliseconds to reach a stable amplitude, which is far too slow. To achieve a virtually instant start-up, a step voltage VBIAS is applied across the sensor through resistor R2.

If a coin is in the magnetic field of the sensor S1, the loss resistance RL1 increases, reducing the gain of amplifier A and its output voltage amplitude VOSC. The sensor inductance L1 can also be shifted up or down, which alters the resonant frequency.

Each sensor S1–4 is connected in its own oscillator circuit such as 16, is enabled by a bias voltage VBIAS and has its feedback switched in via multiplexers M1. Multiplexing is used so that all sensor circuits can share common detection circuitry to produce an input to the microcontroller 11 on a single input line, as will be now be explained in more detail.

The output from each oscillator is switched through the multiplexer switch M1 to feed (signal VOSC) into both a high speed comparator CP1 and a sample-hold circuit SH1. The high speed comparator CP1 acts as a gain limiter thereby producing a square wave rail-to-rail output VOSCSQ, allowing a controlled amount of feedback to be applied to keep the oscillator operating in a linear region i.e. giving a sine wave output and not going into saturation. VOSCSQ passes through the second multiplexer switch M2 so that a different amount of feedback can be set for each sensor using each individual feedback resistor R1. A third multiplexer switch M3 switches the DC offset voltage VBIAS to the selected oscillator circuit and resistor R2 forms a potential divider with R1 to set the feedback signal voltage superimposed on VBIAS. As previously mentioned, VBIAS quickly initialises the oscillations when the circuit is selected by the multiplexer switches M.

When a sensor is deselected, the +ve input of oscillator amplifier A1 is pulled to GND by resistor R4, so A1's output is also at GND. The voltage on the common end of C1 and C2 (connected by L1) is grounded by a high value resistor R5 and so both ends of C1 and C2 are at GND potential. All multiplexers are disabled for about 5 $\mu$S while the sensor address changes to prevent transients and charge transfer from one sensor's resonant capacitors to the next, which would affect the start-up signal amplitude. At the scanning speeds required, there is not enough time to wait for wrong output levels to stabilise. Thus, when the sensor S is selected (i.e. S1 and circuit 16 in FIG. 3) and multiplexers re-enabled, VBIAS is switched onto A1 +ve input and the −ve input is driven to the same level by the amplifier. This puts VBIAS on the top end of C1 as shown in FIG. 3 and therefore across the sensor S1 as well, which starts off a natural oscillation with a peak-to-peak voltage of VBIAS and a DC level of VBIAS/2. Feedback resistor R1 in conjunction with R2 is set to sustain the oscillation at exactly this voltage when no coins are present, so the oscillator achieves instant start up at the required amplitude. If coins are present, the extra effective resistance of the sensor S1 causes the output amplitude to decrease rapidly (typically in about 200 $\mu$S) to its new level. This is the main source of delay that occurs when switching between sensors and to counteract this, a counter (not shown) in the microcontroller 11 counts a predetermined number of cycles of the oscillator output in order to provide a dwell period for at each sensor, before a stable reading can be taken. The same counter is used for frequency measurements as will be described in more detail hereinafter and the count values can be optimised for maximum scanning speed or frequency measurement accuracy.

Because the C-L-C sensor network (i.e. C1, S1, C2) has a low impedance at resonance, only a small voltage has to be applied across it to maintain oscillation—typically less than 0.2V. Resistor R3 is chosen to amplify this voltage for the highest A1 output swing possible without the amplifier going into saturation, to give maximum signal-to-noise ratio. At the resonant frequency, the amplifier has high gain but at DC and frequencies off resonance, the sensor network has a high impedance and so it has unity gain. VOSC therefore consists of primarily a sine wave whose amplitude depends on sensor resistance which in turn is a function of coin presence and coin denomination, together with a small square wave of fixed amplitude equal to the feedback voltage and also the DC offset of VBIAS.

Demodulator Section

As previously mentioned, a common sample-hold circuit SH1 is provided to amplitude demodulate the output of the amplifier VOSC in order to detect successive samples of the envelope of amplitude change produced by the passage of a coin past each of the coil units S.

The demodulator uses sampling with a low cost analogue switch SW to produce an instantaneous DC output equal to the minimum value of the oscillator output VOSC and an amplifier A2 buffers this voltage and adds gain to make full use of the microcontroller 0V to 5V A/D input range. The amplifier A2 also acts as a low pass filter to remove out of band noise. The sampling gives very fast demodulation and can track the output voltage at each cycle of oscillation for amplifier A1, unlike diode detector type demodulators, which can only give a fast response in one direction.

The sample-hold circuit SH1 is triggered at a predetermined phase for each cycle of oscillation of A1, by a trigger signal derived from the sensor network, as will now be explained. When A1 is oscillating at resonance, the current IR through R3 will be in phase with the output voltage VOSC and the feedback voltage (a portion of VOSCSQ). This current also flows through the resonant C-L-C circuit to GND. The two resonant capacitors C1 and C2 are high quality COG types which have a very low loss angle (and high stability) so the voltage developed across C2 will always lag the current IR and therefore VOSC by 90°. The voltage on C2 is fed via multiplexer M4 (as VCAP) to another high speed inverting comparator CP2 to generate a square wave VCAPSQ that will always have its rising edge coincident with the minimum of VOSC (when VCAP crosses VBIAS). A monostable MN reduces the positive pulse width to about 150 nS and the resulting pulse (SAMPLE) momentarily closes switch SW to store the VOSC minimum voltage on capacitor CS. Resistor RS in series with CS, reduces the effects of high frequency charge injection spikes from the analogue switch control input.

The width of the sampling pulse is calculated from the need to capture the VOSC minimum with a reasonable accuracy without requiring a very high current to charge CS and a very fast, low resistance analogue switch. A sine wave is within 0.25% of its peak for ±4° (=$\cos^{-1}(0.9975)$) or about ±110 nS at 100 kHz. A small amount of advance is added to the sampling signal so that its falling edge, closing the switch, is coincident with VOSC minimum rather than its rising edge. This is achieved using R5 and R6, which also keep the sensor DC level at Vbias/2 while the sensor is selected.

Figure 4:
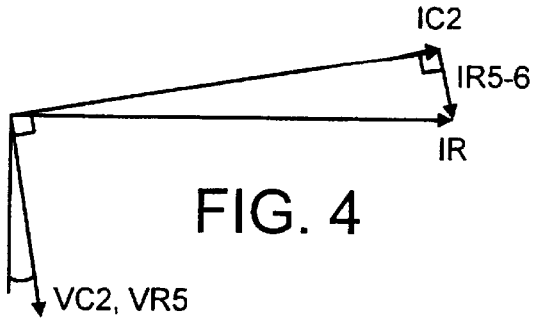
FIG. 4 is a vector diagram for signals shown in FIG. 3.

The sensor current IR splits between the capacitor C2 (IC2) and the bias resistors R5 and R6, which appear in parallel (IR5–6). IC2 leads VC2 and IR5–6 by 90° as shown in FIG. 4. VC2 therefore lags IR and VOSC by slightly less than 90°, advancing the SAMPLE pulse.

The resulting signal developed on CS is amplified by amplifier A2 and fed on line 17 to the microcontroller 11 shown in FIG. 2 for further processing. It will be understood that the output on line 17 comprises multiplexed sequence of analogue samples of the amplitude of the envelope of oscillations of the sensor coils units S1–4. These samples are digitised by the microcontroller for further processing and comparison with window data stored in the EEPROM 12, as previously explained.

The described circuit has the advantage that the multiplexer can be operated at a much faster rate than hitherto. Typically with prior art parallel circuits as described in GB-A-2 169 429, supra, a period of 2 milliseconds per sensor circuit was needed for the sensor coil to stabilise and produce a useful output. In contrast, with the described circuit according to the invention, useful data can be obtained in 200 $\mu$S, so that the scanning frequency can be increased by a factor of ten in accordance with the invention.

Frequency Measurement

Additionally, measurements can be made of the frequency excursion that occurs when a coin passes the sensor coils. Measurements of the frequency of VCAPCSQ are made using two counters (not shown) within the microcontroller 11. One counter records the number of cycles of VCAPCSQ, and the other is a high speed counter (5 MHz) that measures how long it takes for a given number of cycles to occur. The signal VCAPSQ is fed on line 18 (FIG. 3) to the microcontroller 11.

When a sensor S is selected by the multiplexer M in FIG. 2, a small number of cycles are ignored by the counters to allow the interaction between the sensor magnetic field and the coin to produce a stable output, and then a reading is then taken from the high speed counter. After the required number of VOSCSQ cycles, a second reading is taken and the difference between these two readings taken. The result is compared with corresponding results when no coin is present, which is stored as a reference, to check for any change in frequency.

By timing over a larger number of cycles, higher accuracy can be obtained at the expense of slower scanning speed. Preferably, just one sensor is used for frequency measurements and it is allocated more time (cycles) than the other sensors. The end of the cycle count is also used as the time when the amplitude reading is taken from the A/D input (for line 17) before moving on to the next sensor. From this it can be seen that each sensor is allocated a number of cycles rather than a fixed time period and higher frequency sensors with faster response can be scanned in less time.

Series Resonant Circuit

The series resonant configuration of the sensor coil S1 and capacitors C1, C2 reduces effects on the sensor readings of common mode noise on the power supply to the circuits shown in FIG. 3. Differential noise, where the noise is only of one of the rail voltages for the circuit, can normally be filtered out. However, common mode noise which appears on both supply rails with respect to earth is much more difficult to suppress. The acceptor circuits have no earth rail and thus there is no suitable noise-free reference which can be used as a basis for filtering out the noise.

Common mode noise causes a problem in the inductive sensor circuits of a coin acceptor because noise currents can flow from the power supply back through the circuits, sensors and connections via stray capacitance to earth. These noise currents generate voltages that combine with true sensor voltages to produce errors in the sensed coin parameters.

Also, noise can combine with the output of the oscillator to produce sum and difference amplitude modulations. The sum signals have a relatively high frequency and can usually be filtered out by the low pass filter associated with amplifier A2. However, the difference signals may be more problematic because they may be of a frequency corresponding to the envelope of modulation produced by a passing coin, which can give rise to erroneous sensor outputs.

The series resonant configuration according to the invention, however suppresses the effect of noise currents flowing through the stray capacitance as will now be explained. Considering the series connection of sensor coil S1 and the two identical capacitors C1 and C2, the resonant frequency of this sensor network is:

$$\omega_r=1/\sqrt{(L1*C1/2)}$$

Typical noise voltages that are high enough to cause problems are of the order of 20V peak-to-peak amplitude. The excitation voltage for the series resonant circuit developed at the −ve input of amplifier A1 is much smaller in comparison—of the order of 0.2V peak-to-peak i.e. 100 times smaller. So far as the noise voltage is concerned, this −ve input point is a virtual GND.

Figure 5:
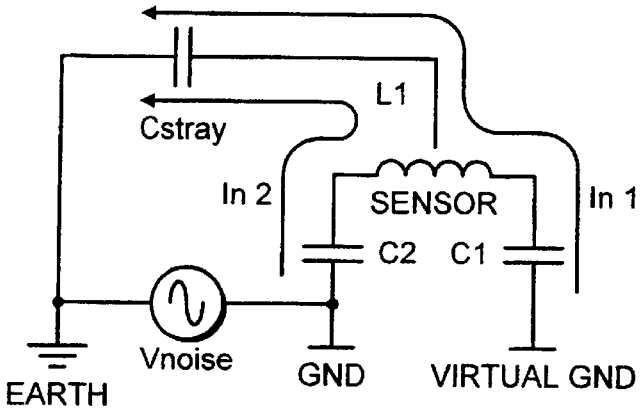
FIG. 5 is a schematic diagram of the sensor coil circuit 16 shown in FIG. 3, for the purpose of explaining noise suppression.

The stray capacitance CSTRAY of the circuit can be considered as a capacitor of the order of 50 pF connected to the midpoint of the sensor coil, as shown in FIG. 5. The noise current passing through the electrical centre of the coil through the stray capacitance to earth gives rise to a resonant frequency $$\omega_{rn}=1/\sqrt{(C1*L1/2)}$$

This is clearly the same resonant frequency as the sensor signals themselves, to be detected by the circuit. As the two halves of the resonant network shown in FIG. 5 have identical impedances (C1+L1/2 and C2+L2/2) the two noise currents In1 and In2 flowing in the two halves of the circuit, will be equal and opposite, resulting in zero noise voltage at the −ve input to amplifier A1.

The gain of the amplifier A1 at the resonant frequency is set to be approximately 20, in this example so as to produce an output voltage 4V peak-to-peak from the 0.2V sensor input. Off resonance, the impedance of the C-L-C sensor network rapidly increases and the gain tends towards unity.

Figure 6:
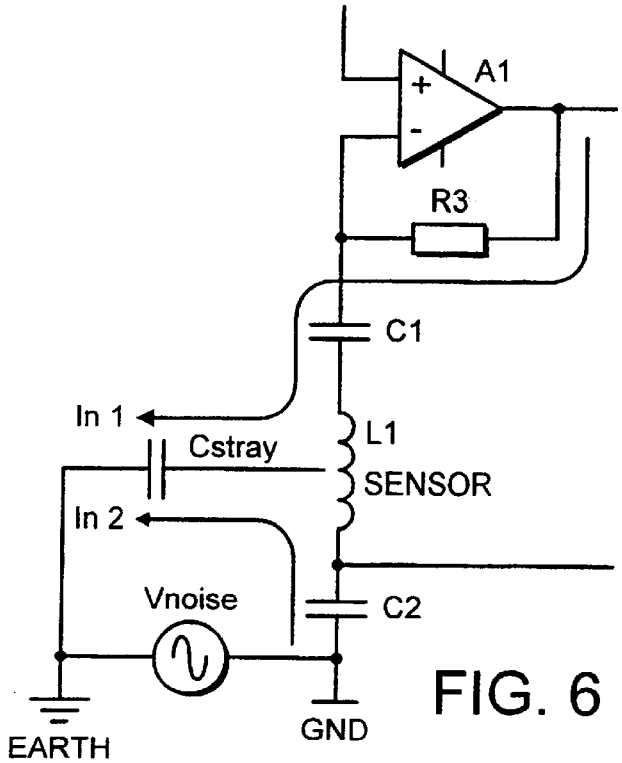
FIG. 6 is a schematic diagram illustrating noise currents flowing in the input to amplifier A1 of FIG. 3.

Thus, when In1 and In2 are equal, no noise voltage will be developed at the input to A1 and so no amplified noise will occur. The only remaining noise voltage will be that produced by noise current flowing through resistor R3 i.e. In1×R3 as shown in FIG. 6. However, because R3 and In1 are both relatively low, the resulting noise voltage is very small.

This analysis assumes that the stray capacitance is connected centrally of the sensor S1. For noise currents at the sensor resonant frequency coupled through places other than the coil centre, the inductance seen will not be L1/2 and the noise will not see a low impedance network but instead a high impedance, off-resonance network. Thus, such noise currents are suppressed. There will be some other frequency at which resonance will occur between δL1 and C1 or C2 but the induced noise voltages will only undergo low gain from the amplifier A1. Thus, in accordance with the invention, the series resonant circuit gives rise to a substantial improvement in noise suppression.

Many modifications and variations fall within the scope of the claimed invention. For example, in the described embodiment, each sensor coil S comprises a single inductor. However, more than one inductor coil can be used connected either in phase, or in phase opposition and the two coils may be arranged on opposite sides of the coin rundown path shown in FIG. 1 rather than on one side only. Also, more than four sensor coil units may be used. It will also be understood that the signals from the post acceptance sensor PS shown in FIG. 1 can also be processed by the circuitry shown in FIG. 3, using additional inputs to the multiplexer switches M. Furthermore, in the described example, the sensor coils are scanned in a regular sequential pattern. However, it may be desirable in certain circumstances to change the scanning pattern so that more samples are taken from certain ones of the sensor coils than others.

Furthermore, the sensor can be used to detect not only coins but also tokens and as used herein, the term coin includes a token or other coin-like item.

What is claimed is:

1. A sensor for a coin acceptor, comprising an inductor for forming an inductive coupling with a coin to be tested, connected in series between first and second capacitors in a self oscillating circuit, and a detector to detect changes in oscillatory characteristics of the circuit as the coin passes the inductor.

2. A sensor according to claim 1, wherein the self oscillating circuit includes an amplifier and the series connected inductor and capacitors comprise a sensor network that is connected to the amplifier to alter the oscillatory characteristics of its output as the coin passes the inductor.

3. A sensor according to claim 2 wherein the amplifier has a first input (+) connected in a feedback loop to its output and a second input (−) to which the sensor network is connected.

4. A sensor according to claim 3, wherein the inductor comprises a coil having an inductance and a resistance.

5. A sensor according to claim 2, wherein the inductor comprises a coil having an inductance and a resistance.

6. A sensor according to claim 2, wherein the detector includes a sample and hold circuit configured to sample the amplitude of the output of the amplifier in a predetermined phase relationship to cycles thereof.

7. A sensor according to claim 6 including a trigger circuit to trigger operation of the sample and hold circuit, the trigger circuit being responsive to a signal in the sensor network which has a phase delay relative to the output of the amplifier.

8. A sensor according to claim 1, wherein said first and second capacitors are of substantially the same value.

9. A sensor according to claim 1, wherein the detector is configured to sample repetitively the amplitude of the oscillatory characteristics of the self oscillating circuit.

10. A sensor according to claim 1, including means for identifying a predetermined amplitude criterion in the oscillatory characteristics of the circuit as the coin passes the inductor.

11. A sensor according to claim 1, wherein the detector includes a frequency detector to detect the frequency of the oscillatory characteristics of the circuit.

12. A sensor according to claim 11, including a timer to monitor the time taken for a given number of the cycles of the oscillatory output of the circuit to occur.

13. A sensor according to claim 11 including a counter to count the number of cycles of the oscillatory output of the circuit that occur within a given time.

14. A sensor according to claim 13, including a timer to monitor the time taken for a given number of the cycles of the oscillatory output of the circuit to occur.

15. A sensor circuit according to claim 1, including means for applying a predetermined bias to the circuit at switch-on to reduce switch-on transients.

16. A sensor according to claim 1, including a plurality of said self oscillating circuits and a multiplexer configuration to connect the circuits sequentially to the detector.

17. A coin acceptor including a sensor as claimed in claim 1.

18. A sensor according to claim 8, wherein the detector includes a sample and hold circuit configured to sample the amplitude of the output of the amplifier in a predetermined phase relationship to cycles thereof.

* * * * *